US007858174B2

(12) United States Patent
Ehrman et al.

(10) Patent No.: US 7,858,174 B2
(45) Date of Patent: Dec. 28, 2010

(54) DRAINAGE-PROMOTING WRAP FOR AN EXTERIOR WALL OR ROOF OF A BUILDING

(75) Inventors: Geoffrey N. Ehrman, Doylestown, PA (US); Nathan L. Randello, Bensalem, PA (US); Clarence C. McCorsley, III, Asheville, NC (US)

(73) Assignees: Benjamin Obdyke Incorporated, Horsham, PA (US); Colbond, Inc., Enka, NC (US)

( * ) Notice: Subject to any disclaimer, the term of this patent is extended or adjusted under 35 U.S.C. 154(b) by 0 days.

(21) Appl. No.: 12/556,797

(22) Filed: Sep. 10, 2009

(65) Prior Publication Data

US 2009/0320399 A1 Dec. 31, 2009

Related U.S. Application Data

(62) Division of application No. 11/464,911, filed on Aug. 16, 2006, now Pat. No. 7,607,270.

(51) Int. Cl.
*B32B 27/00* (2006.01)
*B32B 5/12* (2006.01)

(52) U.S. Cl. ..... 428/299.7; 428/114; 156/178; 156/299

(58) Field of Classification Search ..... 52/302.1, 52/302.3, 408, 409, 169.5, 169.14; 428/298.1, 428/298.4, 299.7, 86, 156, 167, 297.4, 114; 442/269, 381; 156/178, 244.11, 290, 292, 156/297, 299
See application file for complete search history.

(56) References Cited

U.S. PATENT DOCUMENTS 346,638 A 8/1886 Burns
1,190,857 A 7/1916 Burgher
1,890,486 A 12/1932 Angier
2,122,926 A 7/1938 Blacher
2,154,734 A 4/1939 Doing
2,312,293 A 2/1943 Weiss
2,332,373 A 10/1943 Dorough et al.
2,724,872 A 11/1955 Herbes
3,654,765 A 4/1972 Healy et al.
4,031,681 A 6/1977 Charniga
4,574,541 A 3/1986 Raidt et al.
4,636,419 A * 1/1987 Madsen et al. ..... 428/131
5,099,627 A 3/1992 Coulton et al.
5,383,314 A 1/1995 Rothberg
5,673,521 A 10/1997 Coulton et al.

(Continued)

OTHER PUBLICATIONS

Ko Sangyo Co., "Rib Sheet" sales brochure, 3 pages, 1989 (month unknown).

*Primary Examiner*—Robert J Canfield
*Assistant Examiner*—Brent W Herring
(74) *Attorney, Agent, or Firm*—Howson & Howson LLP

(57) ABSTRACT

A drainage-promoting wrap includes an elongate web of a weather-resistive membrane and a series of separate, laterally spaced-apart, elongate filament spacers bonded to a face of the membrane. The filaments are preferably extruded polymeric filaments and have depressions formed therein providing transverse drainage paths across the filaments. Preferably, the filaments extend substantially parallel to each other and to a longitudinal axis of the elongate membrane. In addition, preferably the membrane is made of a polymeric material so that the filaments are thermally bonded to the face of the membrane. Wall and roof assemblies utilizing the wrap and methods of making the wrap are provided.

17 Claims, 2 Drawing Sheets

U.S. PATENT DOCUMENTS 5,681,302 A 10/1997 Melbye et al.
5,705,249 A 1/1998 Takai et al.
5,788,907 A 8/1998 Brown, Jr. et al.
5,820,296 A 10/1998 Goughnour
5,826,390 A 10/1998 Sacks
5,958,804 A 9/1999 Brown, Jr. et al.
5,960,595 A 10/1999 McCorsley, III et al.
6,090,234 A * 7/2000 Barone et al. ..... 156/177
6,131,353 A 10/2000 Egan
6,233,890 B1 5/2001 Tonyan
6,331,345 B1 12/2001 Kauschke et al.
6,355,333 B1 3/2002 Waggoner et al.
6,537,935 B1 3/2003 Seth et al.
6,550,212 B2 4/2003 Lubker, II
6,553,734 B1 4/2003 McKague, Jr. et al.
6,557,313 B1 5/2003 Alderman
6,594,965 B2 7/2003 Coulton
6,672,016 B2 1/2004 Janesky
6,691,472 B2 2/2004 Hubert
6,692,606 B1 * 2/2004 Cederblad et al. ..... 156/244.11
6,761,006 B2 7/2004 Lubker, II
6,786,013 B2 9/2004 Coulton
6,804,922 B1 10/2004 Egan
6,869,901 B2 3/2005 Lubker, II
6,878,433 B2 * 4/2005 Curro et al. ..... 428/198
6,881,336 B2 * 4/2005 Johnson ..... 210/321.76
6,952,901 B2 10/2005 Jacques et al.
6,991,535 B2 1/2006 Ciepliski et al.
7,520,097 B2 4/2009 Aalbers et al.
7,670,665 B2 * 3/2010 Hoying et al. ..... 428/133
2003/0200708 A1 10/2003 Parker
2005/0066593 A1 3/2005 Haas et al.
2005/0072072 A1 4/2005 Duncan et al.
2005/0229504 A1 10/2005 Bennett et al.
2005/0229524 A1 10/2005 Bennett et al.
2005/0257469 A1 11/2005 Bennett et al.
2006/0194495 A1 8/2006 Lubker, II
2007/0175145 A1 8/2007 Sacks et al.
2007/0261340 A1 11/2007 Cecillio et al.

* cited by examiner

DRAINAGE-PROMOTING WRAP FOR AN EXTERIOR WALL OR ROOF OF A BUILDING

CROSS REFERENCE TO RELATED APPLICATIONS

This application is a divisional of U.S. application No. 11/464,911 filed Aug. 16, 2006 which issued as U.S. Pat. No. 7,607,270 B2 on Oct. 27, 2009.

BACKGROUND OF THE INVENTION

The present invention relates to managing and preventing the accumulation of moisture within an exterior wall or roof of a building, and more particularly, the present invention relates to a drainage-promoting wrap, its method of manufacture, and a wall and/or roof assembly in which the wrap is used.

Moisture which accumulates within a building structure, such as an exterior wall or roof of a building, can prematurely deteriorate the building structure. It has been recommended to provide ventilation and/or drainage passageways within an exterior wall or roof of a building to prevent the accumulation of moisture. For example, openwork materials can be used in wall/roof assemblies to provide such passageways. See, for instance, U.S. Pat. Nos. 5,099,627; 6,786,013; and 6,594,965.

It is conventional practice to cover inner sheathing members of a wall and/or roof with various types of building papers, tar papers, roofing felts, house-wrap materials, and the like to provide a weather barrier to help block the penetration of air and/or water into the building through an exterior wall or roof. House-wraps made of thermoplastic materials can be designed to permit moisture vapor to escape in an outward direction through the exterior wall or roof. Examples of thermoplastic house-wrap materials include TYPAR housewrap sold by BBA Fiberweb, and TYVEK housewrap sold by Dupont.

Various drainage-promoting weather barrier materials are disclosed by U.S. Pat. Nos.:5,826,390 issued to Sacks; 6,131,353 and 6,804,922 B1 issued to Egan; 6,233,890 B1 issued to Tonyan; 6,355,333 B1 issued to Waggoner et al.; and 6,550,212 B2, 6,761,006 B2 and 6,869,901 B2 issued to Lubker, II.

Although the drainage and/or ventilation mats, building papers, house-wraps, and composite materials disclosed in the above referenced patents may function satisfactorily for their intended purposes, there remains a need for an inexpensive and alternate drainage-promoting wrap that can be utilized in an exterior wall and/or roof assembly of a building to prevent moisture infiltration and to provide drainage paths and/or ventilation air spaces between an inner sheathing member and an exterior building material. Preferably, the wrap should permit ready installation requiring only a minimum of skill and should be capable of efficient and inexpensive manufacture.

BRIEF SUMMARY OF THE INVENTION

More specifically, the present invention is a drainage-promoting wrap for a building. The wrap comprises an elongate web of a weather-resistive membrane and a series of separate, laterally spaced-apart, elongate filament spacers bonded to a face of the membrane. The filaments are preferably extruded polymeric filaments and have depressions formed therein providing transverse drainage paths across the filaments. Preferably, the membrane is made of a polymeric material so that the filaments can be thermally bonded to the face of the membrane.

According to another aspect of the present invention, a wall or roof assembly of a building is provided and includes an inner sheathing member, an exterior building material, and a drainage-promoting wrap sandwiched therebetween. The wrap is a weather-resistive membrane having a series of separate, laterally spaced, elongate polymeric filaments bonded to a face thereof. Preferably, the filaments extend in a longitudinal direction on the membrane and a substantially horizontal direction within the assembly, and preferably the filaments have a series of depressions formed therein at spaced intervals. The depressions provide drainage paths that extend transversely across the filaments and substantially vertically, or downwardly, within the assembly.

According to yet another aspect of the present invention, a method of making a drainage promoting wrap is provided. A series of separate, laterally spaced-apart, elongate polymeric filaments are bonded to a face of an elongate web of weather resistive membrane and the filaments are flattened at spaced intervals along the lengths of the filaments to create drainage paths that extend transversely across the filaments. Preferably, the filaments are thermally bonded to the face of the elongate web and extend in a longitudinal direction thereon.

BRIEF DESCRIPTION OF THE DRAWINGS

The features and advantages of the present invention should become apparent from the following description when taken in conjunction with the accompanying drawings, in which.

DETAILED DESCRIPTION OF THE INVENTION

Figure 1:
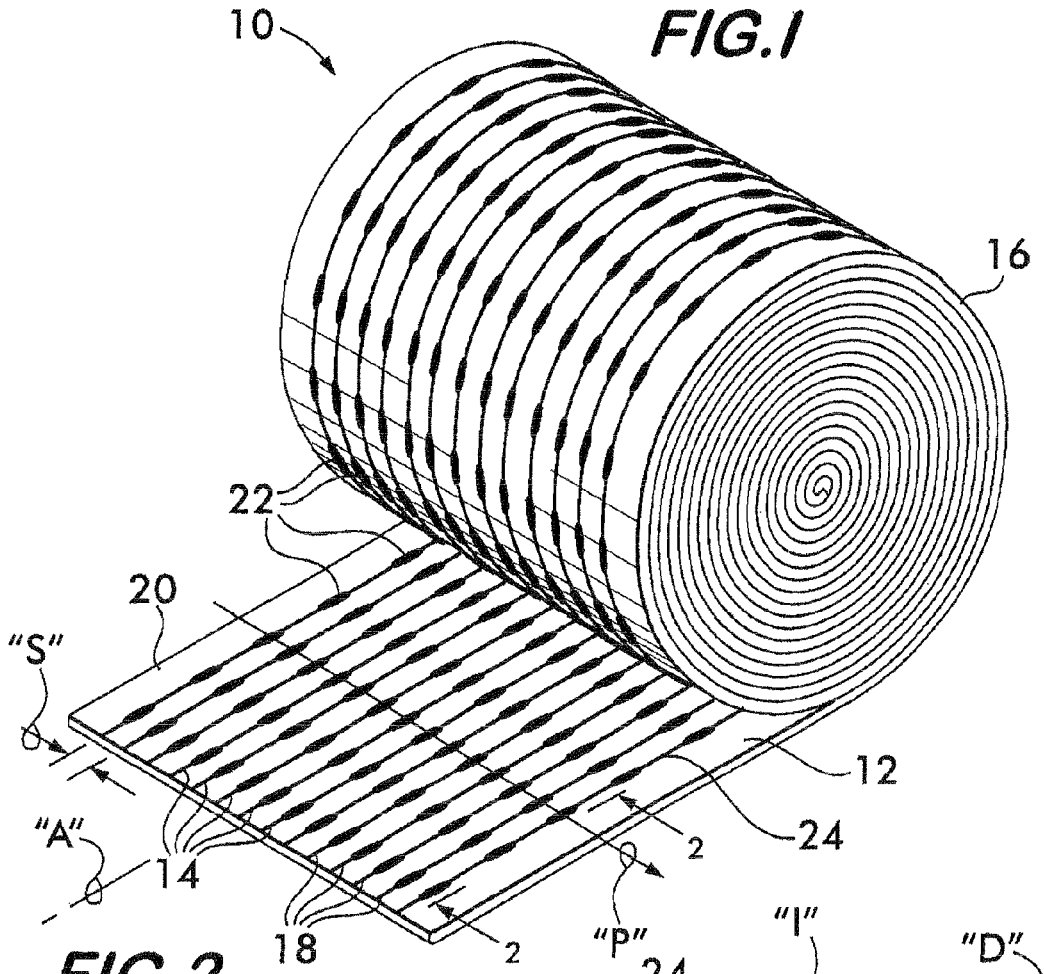
FIG. 1 is a perspective view of a spiral roll of a drainage-promoting wrap according to the present invention.
Figure 2:
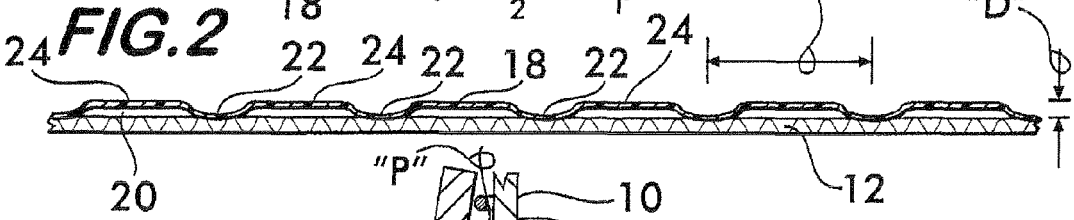
FIG. 2 is a cross-sectional view of the wrap taken along line 2-2 of FIG. 1.

Referring now to the drawings, FIGS. 1 and 2 illustrate an embodiment of a drainage promoting wrap 10 according to the present invention. The wrap 10 includes a weather resistive membrane 12 to which a series of separate, laterally spaced-apart, elongate spacer elements 14 are bonded. The wrap 10 can be stored and shipped in a spiral roll 16 as best illustrated in FIG. 1 and can be unrolled and applied as a weather barrier covering on inner sheathing members of an exterior wall or roof of a building. The membrane 12 provides a barrier to water and/or air infiltration and can also permit water vapor to escape outwardly through the wall or roof. The spacer elements 14 ensure that drainage and/or ventilation passageways are provided within the exterior wall or roof assembly to prevent any moisture that enters the wall or roof assembly from being permitted to accumulate therein.

The membrane 12 can be made of any weather barrier material that can be provided in an indefinite-length elongate web and that is capable of being stored and shipped in a spiral roll 16. For example, the membrane 12 can be made of paper, tar paper, felt, roofing felt, or the like. If thermal bonding of the spacer elements 14 is desired, the membrane is preferably made of a polymeric material such as a thermoplastic material, a synthetic resin, olefin resin, polyolefin polymer, polypropylene, high density polyethylene, polystyrene, nylon, PVC or the like. In addition, the membrane 12 can be a woven material, a non-woven material, a dry-laid non-woven material, a wet-laid non-woven material, a hybrid non-woven material, a polymer-laid non-woven material, a spun-bonded non-woven material, a flash-spun non-woven material, or the like.

The spacer elements 14 according to the present invention are filaments 18. Each filament 18 is bonded to a face 20 of the membrane 12 and extends essentially in a generally longitudinal direction on the membrane 12. In the illustrated embodiment, the filaments 18 are laterally spaced-apart, do not intersect, and extend substantially parallel to each other and parallel to a longitudinal axis "A" of the elongate membrane 12. Thus, each filament 18 shown in FIG. 1 extends in a straight line path. Alternatively, the filaments of the present invention can extend in non-linear, undulating, wavy, or random paths or the like and can intersect and/or cross at random locations or at uniform spaced intervals.

Each filament 18 illustrated in the drawings has a substantially circular cross-section of a predetermined diameter "D". Of course, other cross-sectional shapes can be utilized, such as square, rectangular, oval and triangular filament cross-sections. Accordingly, each filament 18 projects a distance "D" from the face 20 of the membrane 12 to provide spacing between an adjacent building material and the face 20 of the membrane 12. In addition, a series of depressions 22 are formed in the filaments 18 to provide transverse drainage paths "P" across the filaments 18.

The depressions 22 can be created by flattening the filaments 18 at spaced-apart intervals along the length of the filaments 18. Thus, as best illustrated in FIG. 2, each filament 18 includes an alternating array of depressions 22 and full size filament sections 24. The flattened sections of the filaments 18 forming the depressions 22 project a distance from the face 20 of the membrane 12 less than that of the diameter "D" of the full size filament sections 24. This permits the drainage of moisture and/or the flow of air transversely across the filaments 18. Preferably, the depressions 22 in adjacent filaments 18 are aligned to provide substantially straight drainage/ventilation paths "P" that extend transversely, more preferably perpendicularly, across the face 20 of the membrane 12. See FIG. 1.

The filaments 18 are preferably made of polymeric materials capable of being extruded onto the membrane or a surface of a conveyer, drum, or the like. For example, the filaments 18 can be made of nylon, polypropylene, polyester, polyolefin, polyethylene, or like material. By way of example, and not by way of limitation, each filament 18 can be extruded such that it has a diameter "D" between about 1/64 to 1/4 inch, can be flattened in intervals "I" of about 0.5 to 6 inches, and can be spaced a distance "S" of about 1/8 to 1 inch from adjacent filaments. Of course, other dimensions, shapes, patterns, etc. can also be utilized.

Preferably, the filaments 18 are thermally bonded to the membrane 12. The polymeric material of the filaments 18 and weather resistive membrane 12 engage, melt and then solidify together to fuse the filaments 18 to the membrane 12 via the application of heat and/or pressure. Thus, no adhesive is required, and a strong bond is formed. The depressed sections 22 of the filaments 18 that are flattened are particularly strongly fused to the membrane 12 since the pressure exerted on the filaments 18 to create the depressions 22 also results in the formation of a strong bond between the filaments and membrane. Adhesive bonding, sonic bonding, mechanical bonding, or other techniques can be utilized depending on the materials of the filaments and membrane.

Figure 5:
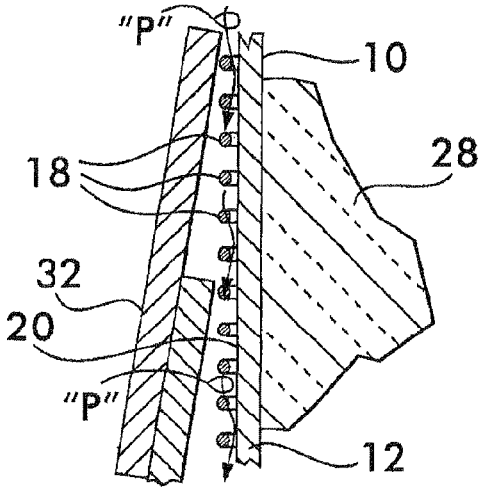
FIG. 5 is an enlarged view of a portion of the wall assembly identified in FIG. 4.
Figure 3:
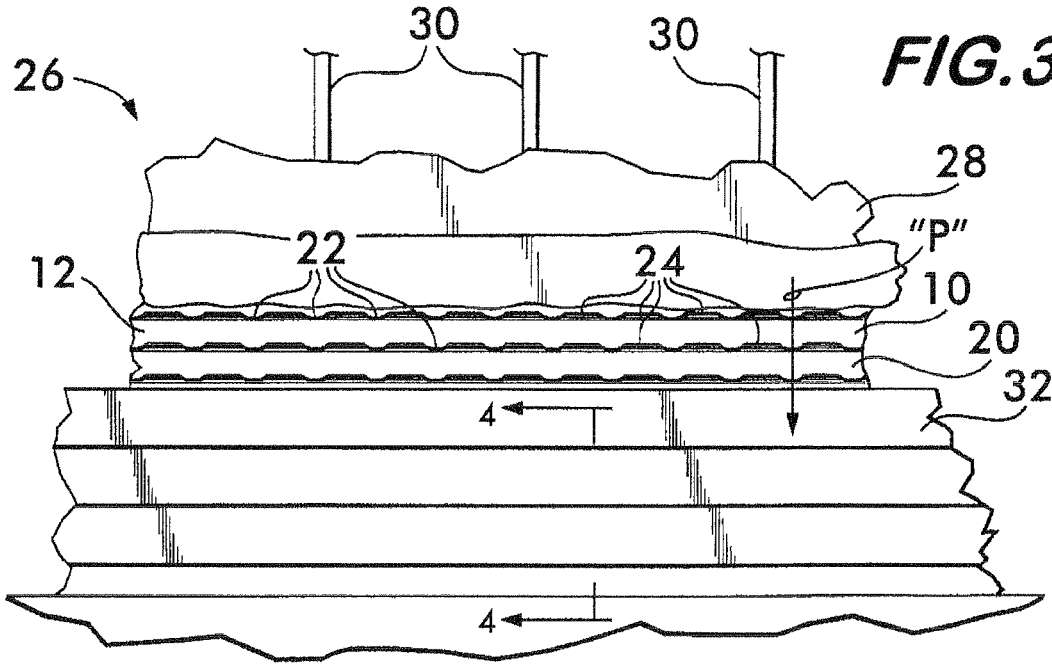
FIG. 3 is a front elevational view of an exterior wall assembly of a building according to the present invention.
Figure 4:
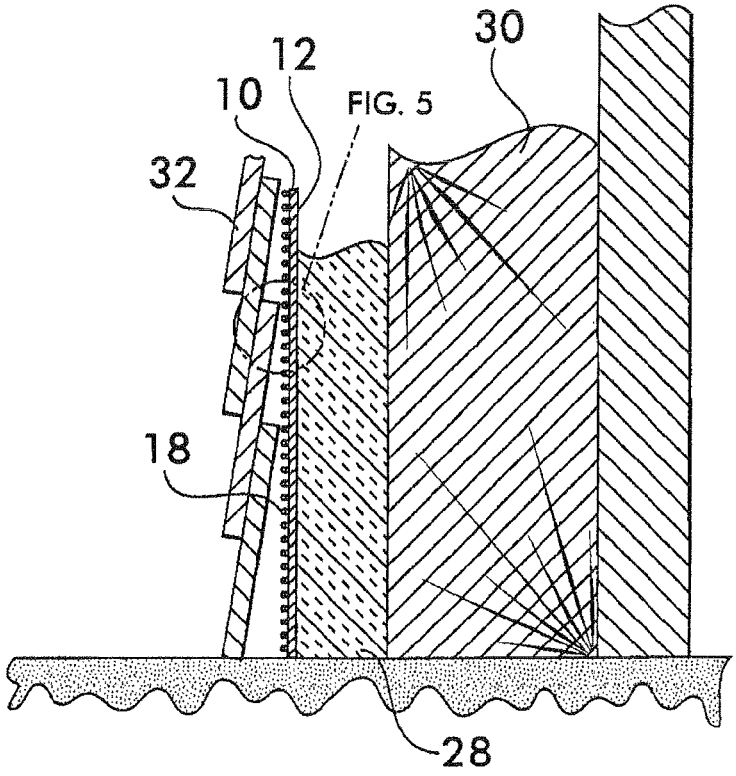
FIG. 4 is a cross-sectional view of the wall assembly taken along line 4-4 of FIG. 3.

An assembly 26 of an exterior wall of a building is illustrated in FIGS. 3-5. Such an assembly could also be utilized for an exterior roof or like structure of a building. The assembly includes inner sheathing members 28 affixed to support posts 30. The inner sheathing members 28 are typically formed of panels of plywood, oriented strand board, particle board, insulated concrete, or other materials permitted by local building codes.

During construction of the assembly 26, the wrap 10 according to the present invention is unrolled on, and secured to, the inner sheathing members 28 such that the weather resistive membrane 12 completely covers the inner sheathing members 28 and such that the filaments 18 face away from the inner sheathing members 28. Typically, the elongate web of wrap 10 is secured to the inner sheathing members with staples or the like and extends horizontally within the assembly 26. Several slightly-overlapping, horizontally-extending rows of the wrap 10 may be required to cover the entire elevation of the assembly 26. Accordingly, the filaments 18 of the wrap 10 extend substantially horizontally within the assembly 26 and the depressions 22 permit moisture to drain vertically, or downwardly, within the assembly 26 transversely across the filaments 18.

An exterior building material 32 is affixed on the outer side of the assembly 26 such that it overlies the wrap 10 and sandwiches the wrap 10 between the inner sheathing member 28 and exterior building material 32. The exterior building material 32 can be, for instance, a wood or fiber-cement siding product or wooden shingles such as cedar shakes. The exterior building material 32 can also be brick, stone, stucco, exterior insulation finish systems (EIFS), vinyl, metal, asphalt, rubber, thermoplastic, and other exterior siding and roofing materials.

As best illustrated in FIG. 5, the filaments 18 space the face 20 of the membrane 12 from the exterior building material 32, and the depressions 22 provide drainage and ventilation paths "P" within the assembly 26. Any moisture which collects within the assembly 26 is provided with a path to drain downwardly under the force of gravity and out of the assembly 26. The multitude of depressions 22 that are present throughout the assembly also enable the circulation of air between the inner sheathing members 28 and exterior building material 32 to aid in drying or evaporating any moisture present within the assembly 26.

A method of making the wrap 10 according to the present invention includes the steps of bonding a series of separate, laterally spaced-apart, elongate polymeric filaments 18 to the face 20 of an elongate web of weather resistive membrane 12 and of flattening sections 22 of the filaments 18 at spaced intervals to create drainage paths "P" that extend transversely across the filaments 18. Preferably, the filaments 18 are bonded to the face 20 of the membrane 12 such that the filaments 18 extend in a substantially longitudinal direction on the elongate membrane 12.

The filaments 18 can be bonded to the membrane by simultaneously extruding a series of laterally spaced-apart, continuous, elongate polymeric filaments directly onto the face 20 of the membrane 12. Alternatively, the filaments 18 can be extruded onto a surface of a traveling conveyor, drum or the like and then transferred to the face 20 of the membrane 12. For example, a plurality of spaced filaments 18 can be simultaneously extruded by an extrusion head onto the surface of a traveling conveyer, drum, or the like. At a downstream location, an indefinite length web of the membrane 12 can be unrolled into engagement with the surface of the conveyer or drum such that the face 20 of the membrane 12 engages the filaments 18. A roller or the like press can be used to apply pressure to the membrane 12 to engage the surface of the traveling conveyor and filaments 18 to cause the filaments 18 to bond to the face 20 of the membrane 12.

The surface of the traveling conveyor or drum can be textured to provide a pattern of recesses and ridges that enable the filaments 18 to be flattened only at desired spaced intervals. For example, where the filaments 18 extend over the ridges of the conveyor or drum, the depressions 22 are formed because the filaments 18 become flattened by the pressure exerted between the underlying ridges and overlying membrane 12. However, where the filaments 18 extend in the recesses of the surface of the conveyor or drum, the filament 18 substantially maintains its extruded cross-sectional shape. Such an arrangement provides a continuous manufacturing process in which the filaments 18 are provided with alternating flattened and full size sections, 22 and 24.

Preferably, the weather resistive membrane 12 is made of a polymeric material and the extruded polymeric filaments 18 are thermally bonded to the face 20 of the membrane 12 when engaged therewith. The heat retained by the filaments 18 upon being extruded can be efficiently utilized to aid thermal bonding of the filaments 18 to the membrane 12 upon contact. After cooling, the membrane 12 and bonded filaments 18 can be rolled into a spiral roll for efficient storage and shipment.

Thus, the above-described drainage-promoting wrap, wall and roof assemblies, and method of manufacture according to the present invention provide a cost effective building product for use in managing moisture within wall and roof building structures.

While preferred wraps, assemblies, and methods have been described in detail, various modifications, alterations, and changes may be made without departing from the spirit and scope of the present invention as defined in the appended claims.

The invention claimed is:

1. A drainage-promoting wrap, comprising:

an elongate strip of weather-resistive membrane storable in a spiral roll; and a series of separate, laterally spaced-apart, elongate spacers bonded to a face of said weather-resistive membrane, said elongate spacers being polymeric filaments;

each of said separate, laterally spaced-apart, polymeric filaments being of a thickness that projects to a predetermined height from said face of said membrane and having a series of depressions formed therein that do not extend to said predetermined height and that provide a series of drainage paths transversely across said filaments; and each of said separate spaced-apart polymeric filaments being a continuous extruded filament that extends in a longitudinal direction on said elongate membrane, including an alternating array of said depressions and full-size filament sections, and being free from intersection with any other filament on said membrane.

2. A drainage-promoting wrap according to claim 1, wherein said series of depressions are located at spaced intervals along a length of each filament and are formed by flattened sections of said filaments.

3. A drainage-promoting wrap according to claim 2, wherein said filaments extend substantially parallel to one another and do not intersect.

4. A drainage-promoting wrap according to claim 3, wherein said filaments extend substantially parallel to a longitudinal axis of said elongate membrane.

5. A drainage-promoting wrap according to claim 2, wherein said weather-resistive membrane is made of a non-polymeric material, and wherein said filaments are bonded to said membrane via sonic bonding, adhesive bonding, or mechanical bonding techniques.

6. A drainage-promoting wrap according to claim 2, wherein said weather-resistive membrane is made of a polymeric material, and wherein said filaments are bonded to said membrane via thermal bonding or sonic bonding.

7. A drainage-promoting wrap according to claim 6, wherein said polymeric material of said weather-resistive membrane is selected from a group consisting of a woven thermoplastic material, a non-woven thermoplastic material, polypropylene, high density polyethylene, nylon, polyester, and polyolefin.

8. A drainage-promoting wrap according to claim 6, wherein said polymeric filaments are made of a material selected from a group consisting of nylon, polypropylene, polyester, polyolefin, and polyethylene.

9. A drainage-promoting wrap, consisting of:

an elongate strip of weather-resistive membrane storable in a spiral roll; and a series of separate, laterally spaced-apart, elongate spacers each separately bonded to a face of said weather-resistive membrane, said elongate spacers being polymeric filaments that are sufficiently spaced-apart such that a portion of said face of said membrane is exposed between each adjacent pair of said separate spaced-apart elongate filaments;

each of said separate spaced-apart elongate polymeric filaments having a series of depressions formed therein that provide a series of drainage paths transversely across said filaments, each of said depressions being formed by a flattened section of said elongate filament, and each of said flattened sections being fused to said membrane to bond said filament to said membrane; and each of said separate spaced-apart elongate polymeric filaments being continuous extruded filament that extends in a longitudinal direction on said elongate membrane, including an alternating array of said depressions and full-size filament sections, and being free from intersection with other ones of said separate spaced-apart elongate polymeric filaments.

10. A method of making a drainage-promoting building wrap according to claim 9, comprising the steps of:

bonding the series of separate, laterally spaced-apart, elongate polymeric filaments on the face of the elongate strip of the weather resistive membrane by flattening said filaments at spaced intervals to create the drainage paths extending transversely across said filaments.

11. A method according to claim 10, wherein said filaments are bonded to said face of said elongate strip such that said filaments extend in a longitudinal direction on said elongate strip.

12. A method according to claim 11, wherein said filaments are bonded to said face of said elongate strip such that the filaments do not intersect.

13. A method according to claim 12, wherein said weather-resistive membrane is made of a non-polymeric material, and wherein said filaments are bonded to said membrane via sonic bonding, adhesive bonding, or mechanical bonding techniques.

14. A method according to claim 12, further comprising the step of extruding said series of polymeric filaments onto said face of said membrane or a surface of a conveyer, before said bonding step.

15. A method according to claim 14, wherein said weather resistive membrane is made of a polymeric material and wherein, during said bonding step, said extruded polymeric filaments are thermally bonded to said membrane.

16. A method according to claim 15, further comprising the step of rolling said membrane into a spiral roll after said flattening step.

17. A method according to claim 10, further comprising the step of applying the series of polymeric filaments as a series of pre-extruded polymeric filaments onto the face of the membrane, before said bonding step.

* * * * *